US010376446B2

(12) United States Patent
Lee et al.

(10) Patent No.: US 10,376,446 B2
(45) Date of Patent: Aug. 13, 2019

(54) PORTABLE PILL DISPENSER DEVICE USING PILL CARTRIDGE WITH ENCLOSED PILL STRIP

(71) Applicant: Nuvizen, Palo Alto, CA (US)

(72) Inventors: Gwongak Lee, Seoul (KR); Chang-Min Pak, Palo Alto, CA (US); MinSung Kwon, San Jose, CA (US); BeLong Cho, Seoul (KR); HoChun Choi, Seoul (KR)

(73) Assignee: NUVIZEN, Palo Alto, CA (US)

( * ) Notice: Subject to any disclaimer, the term of this patent is extended or adjusted under 35 U.S.C. 154(b) by 0 days.

(21) Appl. No.: 15/610,516

(22) Filed: May 31, 2017

(65) Prior Publication Data

US 2017/0354573 A1 Dec. 14, 2017

Related U.S. Application Data

(60) Provisional application No. 62/347,422, filed on Jun. 8, 2016.

(51) Int. Cl.
*A61J 7/00* (2006.01)
*A61J 7/04* (2006.01)
(Continued)

(52) U.S. Cl.
CPC ..... *A61J 7/0076* (2013.01); *A61J 1/035* (2013.01); *A61J 7/0069* (2013.01); *A61J 7/0418* (2015.05);
(Continued)

(58) Field of Classification Search
CPC .. B65H 37/002; B65D 83/0472; A61J 7/0069; A61J 7/0076; A61J 7/0084
See application file for complete search history.

(56) References Cited

U.S. PATENT DOCUMENTS 3,410,450 A * 11/1968 Fortenberry ..... A61J 7/0076 221/25
5,065,894 A * 11/1991 Garland ..... A61F 15/002 221/25
(Continued)

FOREIGN PATENT DOCUMENTS

WO WO 2013/109913 A1 7/2013

OTHER PUBLICATIONS

PCT International Search Report and Written Opinion, PCT Application No. PCT/US2017/035033, dated Aug. 29, 2017, 16 pages.

*Primary Examiner* — Gene O Crawford
*Assistant Examiner* — Kelvin L Randall, Jr.
(74) *Attorney, Agent, or Firm* — Fenwick & West LLP

(57) ABSTRACT

A portable pill dispenser device mountable with one or more pill cartridges that dispense pills by winding a pill strip that encloses pills between flexible films. The pills are enclosed in the pill strip and are released as the films of the pill strip are separated. The pill dispense device include actuators (e.g., motors) that cause winding cylinders in each of the pill cartridges to rotate, causing the pill strip to move towards an opening of each pill cartridge, separate the films of the pill strip, and release the pills through the opening. Indicia may be marked on at least one of the films to enable detection of the moving distance of the pill strip. The pill dispense device includes a sensor for detecting the indicia so that the movement of the films and release of the pills can be tightly controlled.

6 Claims, 6 Drawing Sheets

(51) Int. Cl.
*A61J 1/03* (2006.01)
*B65D 83/04* (2006.01)

(52) U.S. Cl.
CPC ..... *A61J 7/0481* (2013.01); *B65D 83/0463* (2013.01); *A61J 2200/70* (2013.01); *A61J 2205/10* (2013.01)

(56) References Cited

U.S. PATENT DOCUMENTS

| | | | | |
|---|---|---|---|---|
| 6,510,962 | B1 * | 1/2003 | Lim | A61J 7/0481 221/15 |
| 6,962,266 | B2 * | 11/2005 | Morgan | A47L 15/4472 221/25 |
| 7,243,828 | B2 * | 7/2007 | Ricketson | B65H 20/22 226/128 |
| 7,588,066 | B2 * | 9/2009 | Parker | B42C 9/0062 156/249 |
| 8,499,965 | B2 * | 8/2013 | Sheffield | B65H 35/002 221/127 |
| 2005/0177275 | A1 | 8/2005 | Harvey et al. | |
| 2006/0266872 | A1 * | 11/2006 | Parker | B42C 9/0062 242/588.3 |
| 2007/0191753 | A1 * | 8/2007 | Wendorf | A61F 15/001 602/58 |
| 2011/0271811 | A1 * | 11/2011 | Sheffield | B65H 35/002 83/649 |
| 2013/0139662 | A1 | 6/2013 | Greyshock et al. | |
| 2014/0067114 | A1 | 3/2014 | Apell et al. | |

* cited by examiner

PORTABLE PILL DISPENSER DEVICE USING PILL CARTRIDGE WITH ENCLOSED PILL STRIP

CROSS-REFERENCE TO RELATED APPLICATION

This application claims priority under 35 U.S.C. § 119(e) to U.S. patent application Ser. No. 62/347,422 filed on Jun. 8, 2016, which is incorporated by reference herein in its entirety.

BACKGROUND

1. Field of Art

The present disclosure relates to a portable pill dispenser device using pill cartridge that dispenses pills using a strip of pills enclosing pills placed between separable films.

2. Description of the Related Art

Medication non-adherence is a major source of poor health outcomes, but remains a complex, multi-factorial problem in healthcare. One study reported that about a quarter of patients do not even fill their prescriptions within 7 days of hospital discharge, about a third of patients will stop at least one medication with one month of discharge, with about ten percent of patients stopping all medications within one month.

Medication adherence is especially difficult in elderly patients with multiple chronic diseases; the usage of multiple drugs can be difficult to coordinate on a daily basis. Physicians tasked with optimization of medication regimens are also challenged by the lack of patient compliance information, and may be inadvertently increasing dosages or changing drug regimens due to inadequate outcome, when medication non-compliance may be the source of the treatment failure. Compliance information is also useful in a multi-disciplinary care setting, where it may be an indicator of home health needs and living assistance requirements in an aging population.

SUMMARY

Embodiments relate to a pill cartridge that includes a pill strip enclosing pills between a first film and a second film. The pill cartridge includes the pill strip, a first winding cylinder, a second winding cylinder and a body. The first winding cylinder separates the first film from the second film and wind the first film as the first winding cylinder is rotated. The second winding cylinder separates the second film from the first film and wind the second film separated from the first film. The body encloses the pill strip, the first winding cylinder and the second winding cylinder. The body is formed with an opening through which a pill released from the pill strip exits the pill cartridge.

In one embodiment, the pill cartridge further includes at least one gear to rotate the first winding cylinder and the second winding cylinder.

In one embodiment, the first winding cylinder is connected to a first gear and the second winding cylinder is connected to a second gear, the first and second gear coupled via a third gear and a fourth gear.

In one embodiment, the pill cartridge further includes a cover secured to the body. The cover is formed with a hole to access the least one gear.

In one embodiment, the pill strip includes indicia provided at a predetermined interval along a length of the pill strip.

In one embodiment, the indicia are provided in a surface of the second film facing the first film.

In one embodiment, at least two of the indicia has a different resistance value.

In one embodiment, the body is further formed with one or more holes to receive one or more sensing pins for contacting the indicia.

In one embodiment, the one or more pins are pressed against the second winding cylinder to contact the indicia.

Embodiments also relate to a portable pill dispenser device including a pill cartridge where films of a pill strip are separated to release pills in the pill strip. The portable pill dispenser device includes a pill strip and a separator. The pill strip includes a first film, a second film and pills enclosed between the first and second films. The separator separates the first film and the second film to release a predetermined number of pills at a time as the pill strip is pulled toward an opening in the pill cartridge. The portable pill dispenser device also includes an actuator coupled to the separator to operate the separator and a control module for controlling the actuator.

In one embodiment, the portable pill dispenser device includes a sensor configured to determine a length of the pill strip separated by the separator. The control module is operated based on a sensor signal from the sensor.

In one embodiment, the portable pill dispenser device further includes a body enclosing the pill cartridge, the actuator and the control module; and a tray at a side of the body to hold the released pills.

DETAILED DESCRIPTION OF EMBODIMENTS

Figure 1:
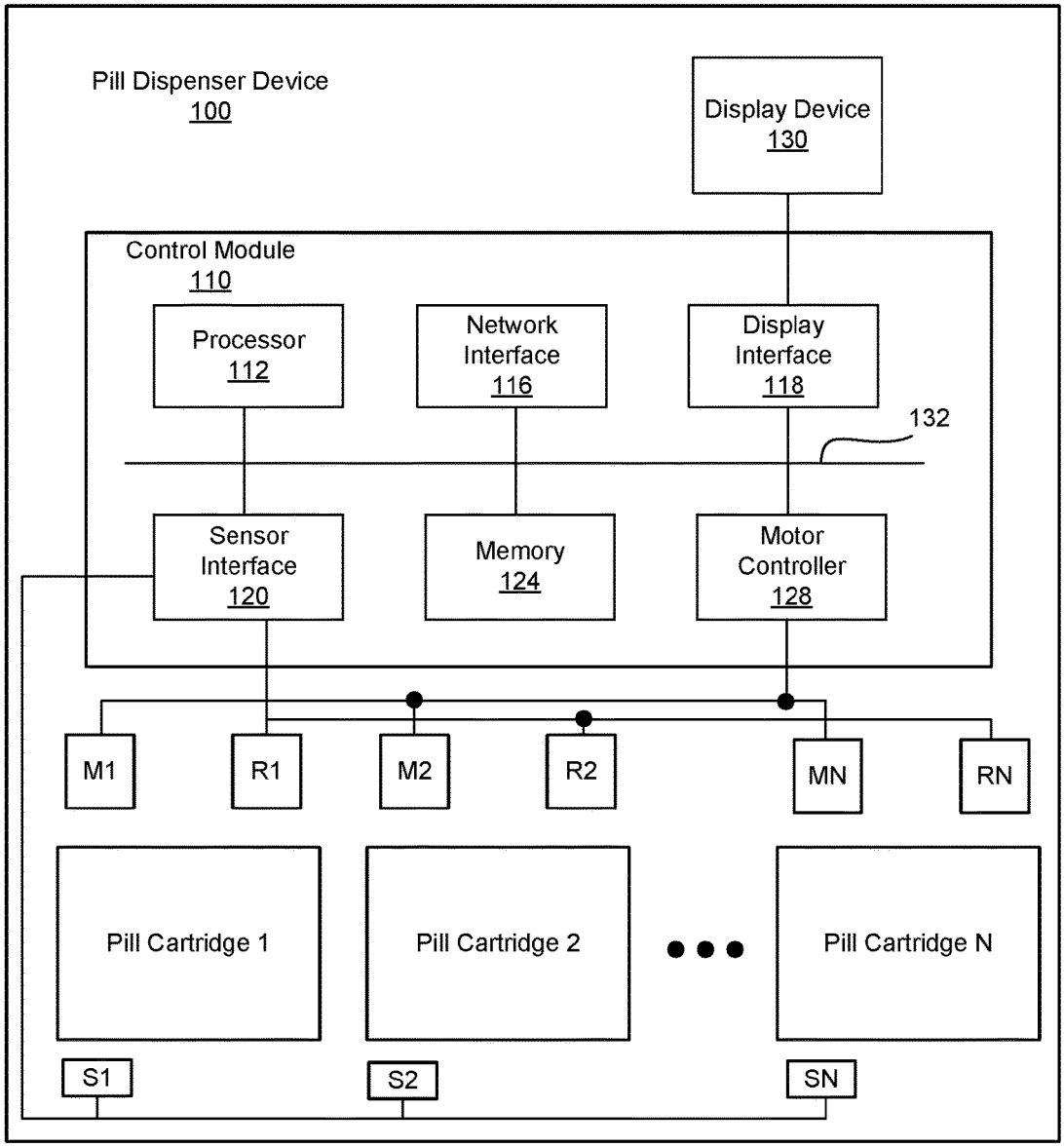
FIG. 1 is a block diagram illustrating components of a portable pill dispenser device, according to one embodiment.

Embodiments are described herein with reference to the accompanying drawings. Principles disclosed herein may, however, be embodied in many different forms and should not be construed as being limited to the embodiments set forth herein. In the description, details of well-known features and techniques may be omitted to avoid unnecessarily obscuring the features of the embodiments.

In the drawings, like reference numerals in the drawings denote like elements. The shape, size and regions, and the like, of the drawing may be exaggerated for clarity.

Embodiments relate to a portable pill dispenser device mountable with one or more pill cartridges that dispense pills by winding a pill strip that encloses pills between flexible films. The pills are enclosed in the pill strip and are released as the films of the pill strip are separated. The pill dispense device include actuators (e.g., motors) that cause winding cylinders in each of the pill cartridges to rotate, causing the pill strip to move towards an opening of each pill cartridge, separate the films of the pill strip, and release the pills through the opening. Indicia may be marked on at least one of the films to enable detection of the moving distance of the pill strip. The pill dispense device includes a sensor for detecting the indicia so that the movement of the films and release of the pills can be tightly controlled.

FIG. 1 is a block diagram illustrating components of a portable pill dispenser device 100, according to one embodiment. The portable pill dispenser 100 is a device that may be carried around by a user and is operated to dispense an accurate number of pills to a user at desired times. The pills may be dispensed at certain programmed times (e.g., 8:00 AM each morning) or by manual activation of the portable pill dispenser 100.

For this purpose, the pill dispenser device 100 may include, among other components, a control module 110, a display device 130, motors M1 through MN, pill cartridges 1 through N, bar code readers R1 through RN, and indicia sensors S1 through SN. The pill dispenser device 100 may also include other components not illustrated in FIG. 1, such as a mechanism for automatically opening or closing a tray for holding pills.

The control module 110 is a combination of hardware, software and firmware that coordinates and controls the overall operations of the pill dispenser device 100. The control module 110 may include, among other components, a processor 112, a network interface 116, a display interface 118, a sensor interface 120, a memory 124, a motor controller 128 and a bus 132 connecting these components.

The processor 112 is a component that executes instructions stored in the memory 124. The processor 112 may be embodied as a microprocessor or a central processing unit (CPU).

The network interface 116 is a component that performs wired or wireless communication with other devices. The network interface 116 may be embodied, for example, as a WiFi module, a Bluetooth module, a local area network (LAN) module, and cellular wireless communication modules. The network interface 116 may communicate with a remote server via a network to present information to the user (e.g., information on price or details of pills) or order pill cartridges.

The display interface 118 is a component that provides image data to the display device 130. In some embodiments, the display interface 118 may receive the user's touch on the display device 130 to generate touch signals. The control module 110 may perform various operations based on the touch signals including, but not limited to, performing transactions associated with ordering pills, scheduling pill dispense times, generating alarm signals when the scheduled times are reached, and providing warning against pills interactions and adverse reaction to the pills.

The sensor interface 120 is connected to one or more sensors in the pill dispenser device 100, and processes sensor signals from these sensors. Although only indicia sensors S1 through SN and bar code readers R1 through RN are illustrated as being connected to the sensor interface 120 in FIG. 1, other sensors may also be provided in the pill dispenser device 100 to detect, for example, whether the tray of the pill dispenser device 100 was opened or closed, how many pills are currently remaining in the tray, and/or whether any pill cartridges are empty.

The memory 124 stores instructions to be executed by the processor 112. The memory 124 may store, for example, an operating system in addition to application programs associated with dispensing or management of pills. The application programs in the memory 124 may facilitate the user's online transactions associated with ordering pills, present user interface screens displaying pill information, schedule pill dispense times, provide information for drug interactions and side effects of the drug, etc.

The motor controller 128 sends driving signals to motors M1 through MN to operate the motors M1 through MN. By operating the motors M1 through MN, pills are released from the pill cartridges 1 through N into the tray of the pill dispenser device 100. In some embodiments, the driving signals may be generated based on sensor signals received from the indicia sensors S1 through SN. That is, when a motor associated with a pill cartridge is operated, an indicia sensor associated with the pill cartridge detects that the pill strip has proceeded along a distance sufficient to release a programmed number of pills, and then causes the control module 110 to stop further rotation of the motor. In other embodiments, the driving signals may be generated without taking into account of any signals from the indicia sensors. For example, the number of rotations of the motor needed to release a pill from the pill strip may be assumed, and control the rotation of the motor under such assumption to release the right amount of pills into the tray.

Each of the motors M1 through MN operates its counterpart mechanism (e.g., a set of gears) to rotate the winding cylinders in its counterpart pill cartridge according to the driving signals generated by the motor controller 128, as described below in detail with reference to FIGS. 6 through 8. Each of the motors M1 through MN is operated individually by the motor controller 128. By individually controlling each of the motors M1 through MN, different combinations of pills from different pill cartridges 1 through N may be dropped into the tray. Moreover, the operation of each of the motors M1 through MN may be based on a sensing signal received from the corresponding indicia sensors S1 through SN. Although the embodiments are described herein as using electric motors to operate the winding cylinders, other actuators such as solenoids or pneumatic valves may be used to operate the winding cylinders.

Each of the bar code readers R1 through RN reads a bar code printed on a pill cartridge. The bar code may be printed on various locations of the pill cartridge, including the end of the pill cartridge that is first inserted into the pill dispenser device 100. By using the bar code, the control module 110 may determine the type of pills included in the pill cartridge and cause the user to take actions (e.g., replace the pill cartridge) if an incorrect pill cartridge was inserted into the pill dispenser device 100. By reading the bar code, the control module 110 may retrieve further information about the pills from a remote server or internal memory. The bar code may also indicate further information including, but not limited to, whether indicia (explained in detail below with reference to FIGS. 8 and 9) are provided on the pill strip and how many total pills are included in the pill cartridge. Each of the indicia sensors S1 through SN detects whether the pill strip in a corresponding pill cartridge is peeled and moved along a predetermined distance. For example, the sensors may detect the change of resistance along the length of the pill strip, as described below in detail with reference to FIG. 8. Also, additional sensors may be placed in each compartment of the tray to detect whether pills dispensed from the pill cartridges were removed by the user.

The components of the pill dispenser device 100 as illustrated in FIG. 1 are merely illustrative. The pill dispenser device 100 may include further components such as a speaker or a cable interface circuit to perform additional functions. The pill dispenser device 100 may also include buttons or keys to receive user inputs or turn on/off the pill dispenser device 100.

Figure 2:
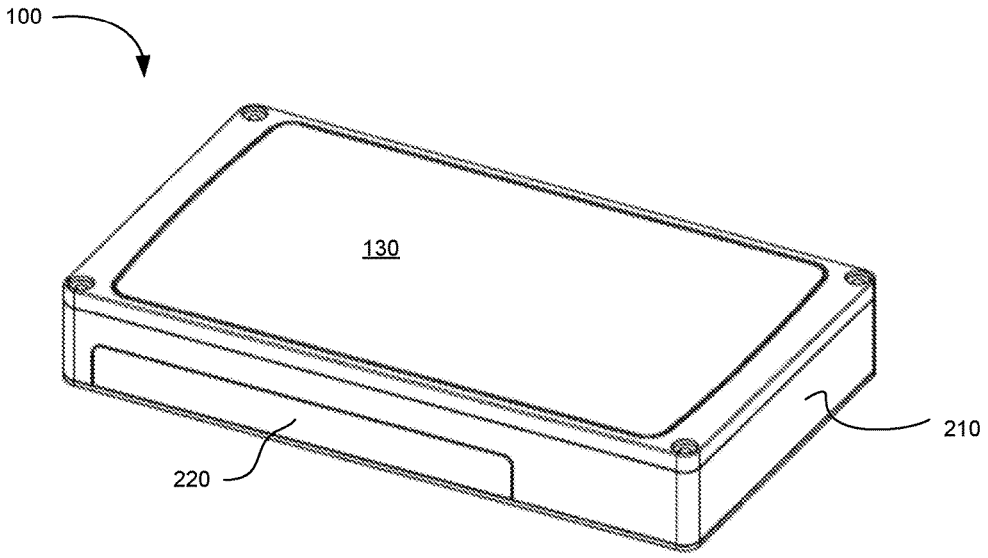
FIG. 2 is a perspective view of the pill dispenser device with its tray closed, according to one embodiment.

FIG. 2 is a perspective view of the pill dispenser device 100 of FIG. 1 with its tray 220 closed, according to one embodiment. The pill dispenser device 100 of FIG. 1 has a body 210 generally of a rectangular block shape. In the embodiment of FIG. 2, the display device 130 is provided on top of the body 210. The display device 130 may include a touch sensor that detects the user's touch on its top surface.

At a side of the body 210, the tray 220 is provided. The tray 220 may be pulled out manually by the user, or may be opened by a motorized mechanism provided in the pill dispenser device 100. When the pill dispenser device 100 is operated with the tray 220 closed, pills from the pill cartridges are dropped into the tray 220. Then, the tray 220 may be opened for the user to retrieve pills from the tray 220.

Figure 3:
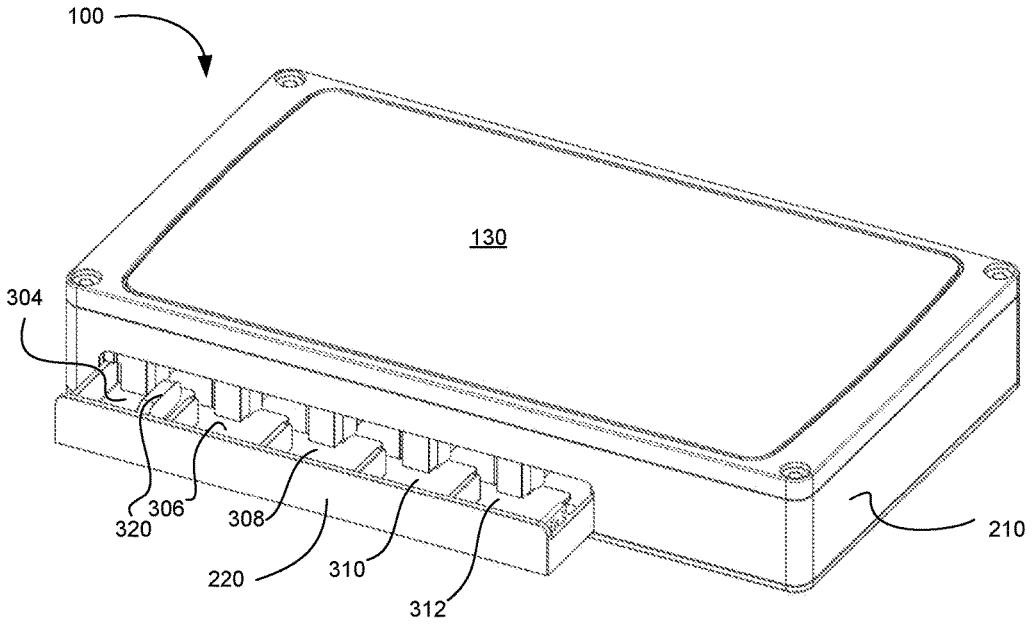
FIG. 3 is a perspective view of the pill dispenser device with its tray opened, according to one embodiment.

FIG. 3 is a perspective view of the pill dispenser device of FIG. 1 with its tray 220 opened, according to one embodiment. The tray may include multiple compartments 304, 306, 308, 310, 312 that hold pills released from corresponding pill cartridges. FIG. 3 illustrates a pill 320 released from a pill cartridge and placed in compartment 304 of the tray 220. Each of the compartments may be dimensioned to hold more than one pill.

Figure 4A:
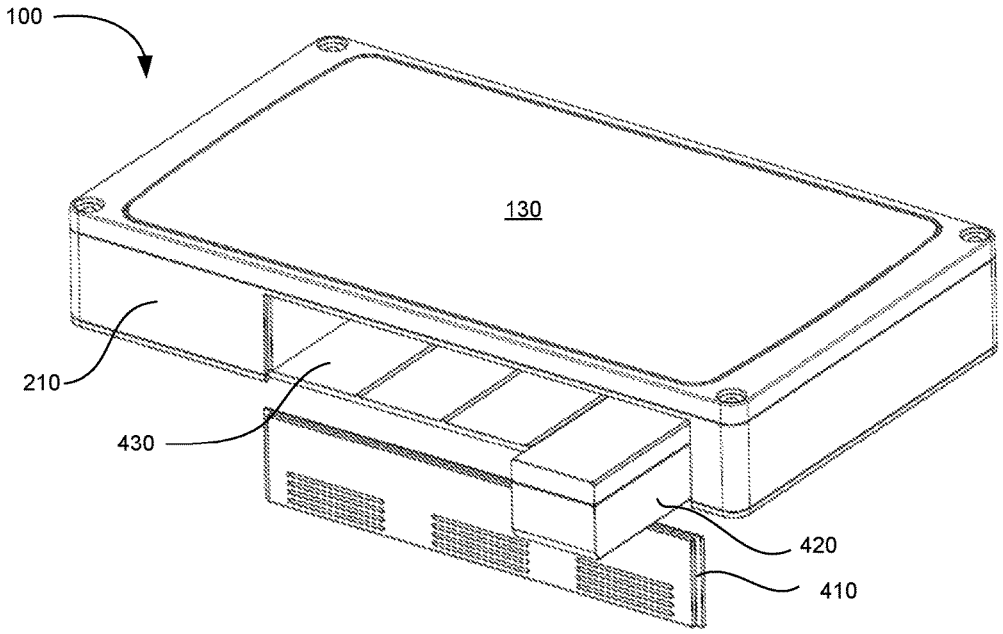
FIG. 4A is a perspective view of the pill dispenser device illustrating insertion or removal of a pill cartridge, according to one embodiment.

FIG. 4A is a perspective view of the pill dispenser device 100 illustrating insertion or removal of a pill cartridge 420, according to one embodiment. The pill cartridge 420 is inserted into or removed from holding space 430 at a side of the body located in the opposite side of the body 210 where the tray 220 is placed. Depending on use, only a single pill cartridge or multiple pill cartridges may be inserted into the holding space 430. After one or more pill cartridges are inserted into the holding space 430, a cover 410 may be attached to the body 210 of the pill dispenser device 100 to shield the holding space 430 and secure the pill cartridges.

To remove or replace pill cartridges, the cover 410 is removed, and then the pill cartridges are pulled out from the holding space 430.

Figure 4B:
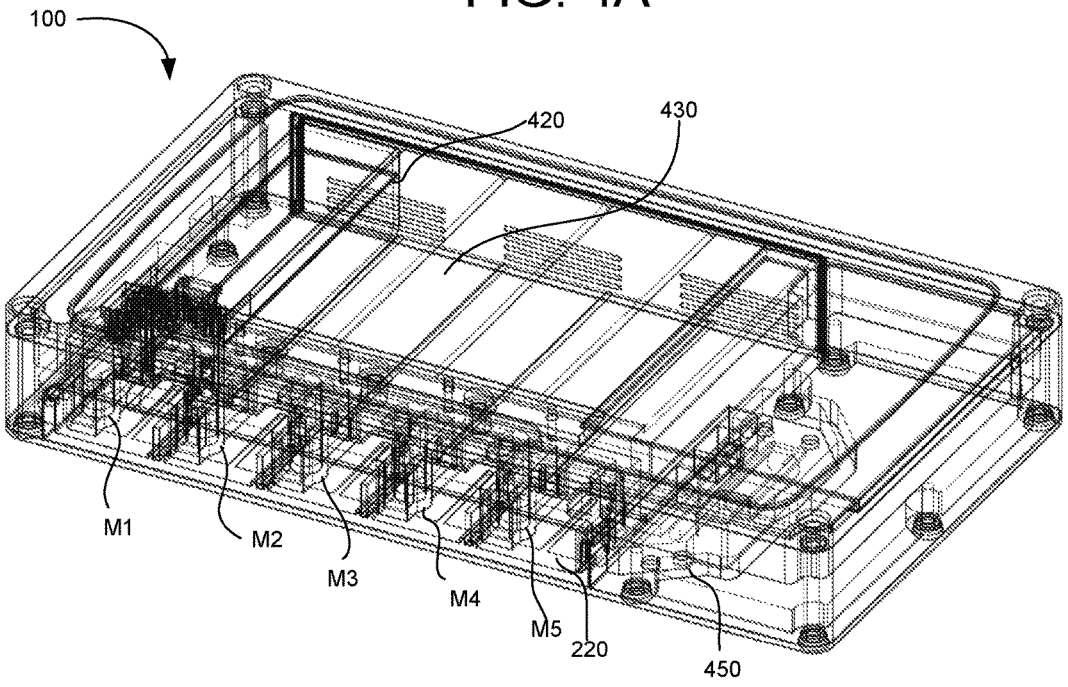
FIG. 4B is a perspective view of the pill dispenser device illustrating its interior components, according to one embodiment.

FIG. 4B is a perspective view of the pill dispenser device 100 illustrating its interior components, according to one embodiment. In FIG. 4B, the pill cartridge 420 is illustrated as being inserted into the holding space 430. FIG. 4B also illustrates motors M1 through M5 for operating the pill releasing mechanisms in the pill cartridges.

In the embodiment of FIG. 4B, the pill dispenser device 100 includes a tray opening lever 450 that is operated by an actuator to automatically open the tray 220. To close the tray 220, the tray may be pushed.

Figure 5:
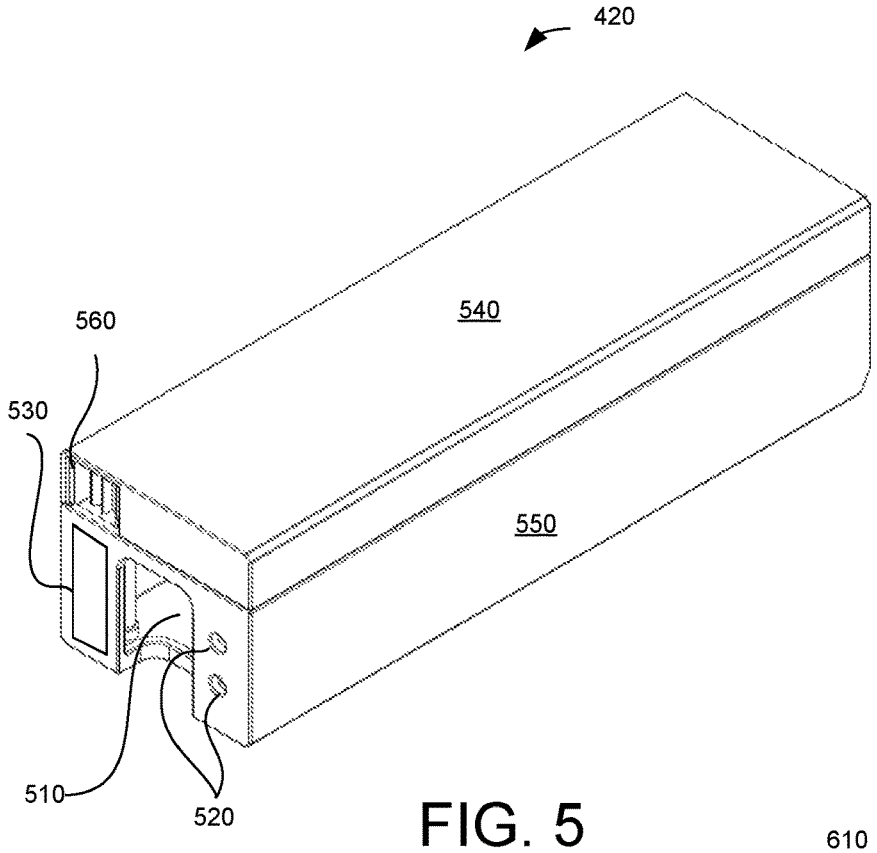
FIG. 5 is a perspective view of a pill cartridge with its cover attached, according to one embodiment.

FIG. 5 is a perspective view of a pill cartridge 420, according to one embodiment. The pill cartridge 420 has a bottom body 550 and a cover 540 attached to the bottom body 550. The bottom body 550 and the cover 540 may be attached in a manner that prevents the user from tempering with the pills enclosed in the pill cartridge 420. A pill cartridge may be purchased by the user as a single unit. After all the pills enclosed in the pill cartridge are dispensed, the entire pill cartridge may be discarded or returned to a provider for refilling.

The front part of the bottom body 550 is formed with an opening 510 through which pills are released into the tray 220. Further, the front part of the bottom body 550 has two holes 520 for receiving sensing pins 634 for coming into contact with a separated film, as described below in detail with reference to FIG. 8. In other embodiments, holes of different dimension and shape may be formed in the bottom body 550 to enable different types of sensors (e.g. infra-red sensor) to sense the interior of the pill cartridge 420 or winding distance of the pill strip.

A front side 530 of the bottom body 550 may be printed with a bar code that may be read by a corresponding bar code reader in the pill dispenser device 100. The bar code may also be printed on other surfaces of the pill cartridge 420 instead of the front side 530.

A front side of the cover 540 is formed with a gear hole 560 to enable access to a gear inside the pill cartridge 420. Gear 620 driven by motor M1 meshes with the gear inside the pill cartridge 420 via the gear hole 560, as described below in detail with reference to FIG. 6.

Figure 6:
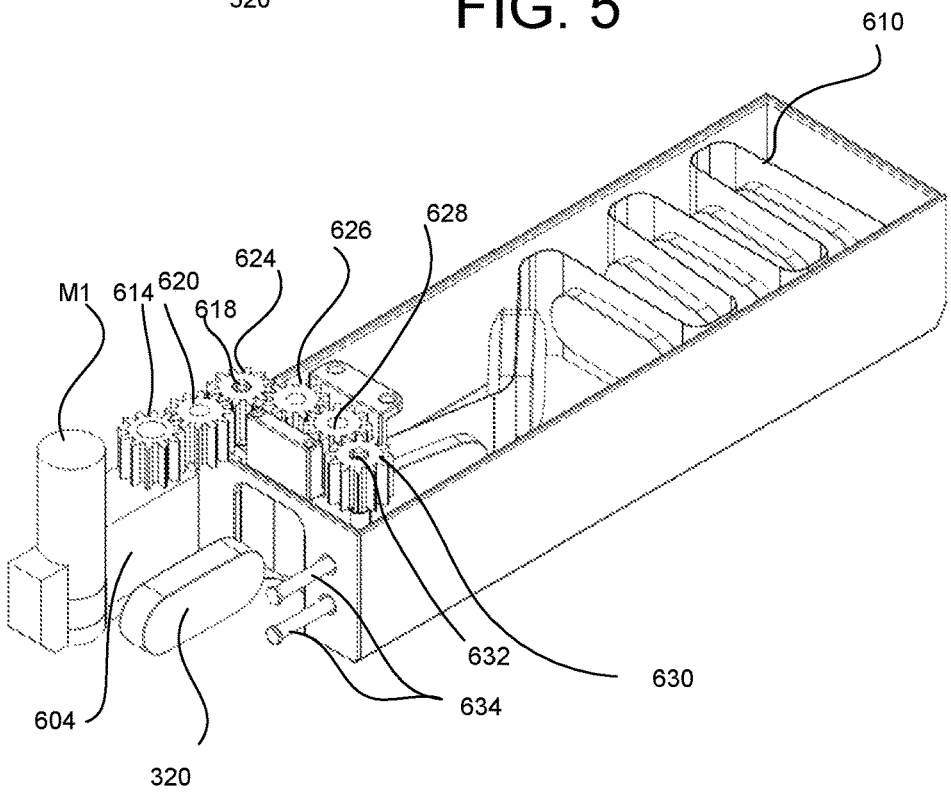
FIG. 6 is a perspective view of the pill cartridge with its cover removed to illustrate interior components, according to one embodiment.

FIG. 6 is a perspective view of the pill cartridge 420 of FIG. 5 with its cover 540 removed to illustrate its interior components, according to one embodiment. Taking the example of the pill cartridge 420 inserted into a first cartridge slot of the holding space 430 as shown in FIG. 4B, the gear 620 in the pill dispenser device 100 meshes with gear 624 in the pill cartridge 420 when the pill cartridge 420 is properly installed in the pill dispenser device 100. When the cover 540 is secured to the bottom body 550, meshing of the gear 624 and the gear 620 occurs through the gear hole 560.

Motor M1 in the pill dispenser device 100 rotates gear 614 through a gear box 604 that transmits driving power from motor M1 to gear 614. As the gear 614 rotates, the gear 620 meshed with gear 614 rotates, subsequently causing rotations in gears 624, 626, 628, 630 in the pill cartridge 420. The gear ratios of gears 624, 626, 628, 630 may be set so that the rotation speed of gear 624 equals the rotation speed of gear 630.

The gear 624 is secured to a winding cylinder 618 so that the winding cylinder 618 rotates with the gear 624. Likewise, gear 630 is secured to a winding cylinder 632 so that the winding cylinder 632 rotates with the gear 630. As the winding cylinders 618, 632 rotate, a pill strip 610 enclosing pills are pulled toward the opening 510, simultaneously separating films of the pill strip 610, and releasing the pills into the tray 220, as explained in more detail below with reference to FIGS. 7 and 8.

Sensing pins 634 are inserted through holes 520 to come into contact with an inner surface of one of the separated films to detect the indicia provided on the inner surface of the separated film. The sensing pins 634 are connected to a sensor (e.g., sensor S1) via wires to detect changes in resistance between the two sensing pins 634. A sensing signal representing the detection of resistance change between the sensing pins 634 may be sent by the sensor to the control module 110 to control the operation of motor M1.

Figure 7:
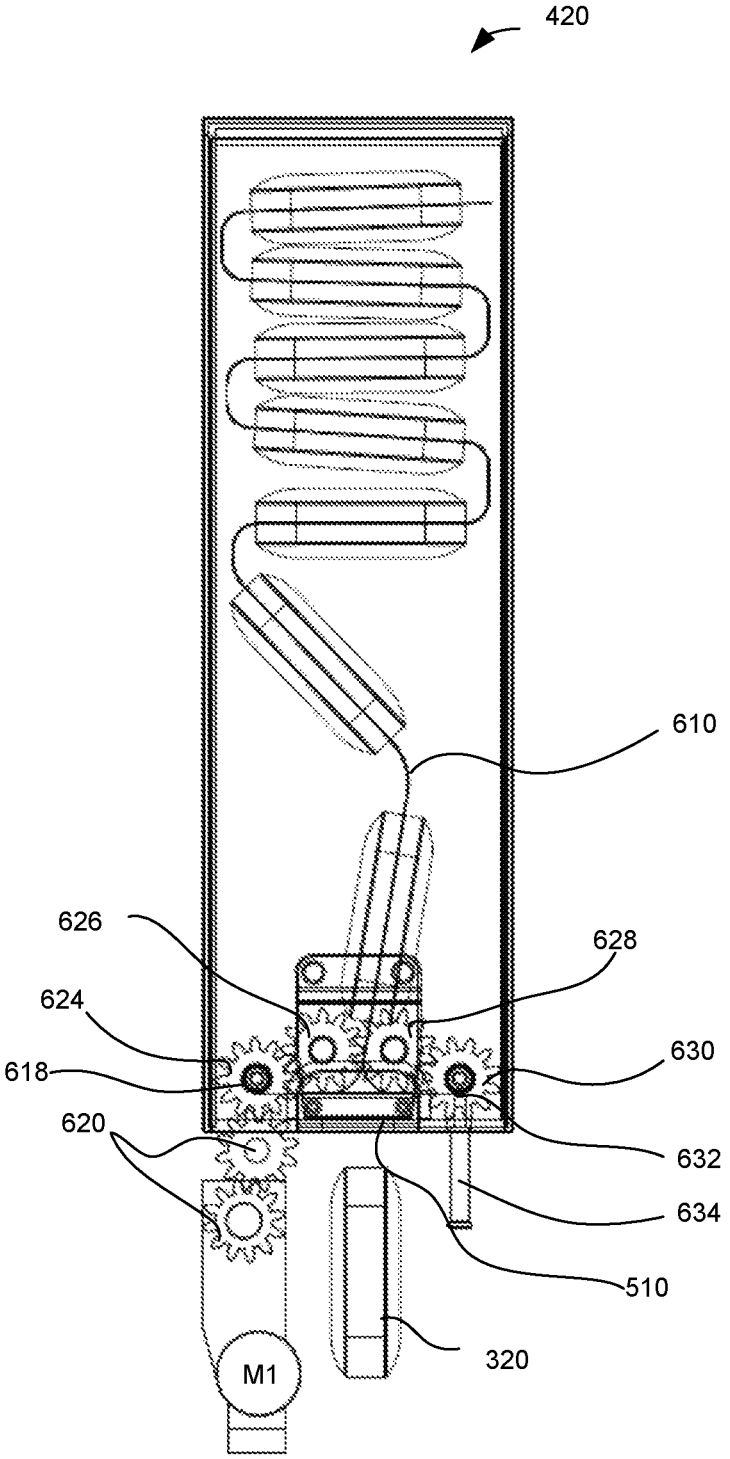
FIG. 7 is a plan view of the pill cartridge, according to one embodiment.

FIG. 7 is a plan view of the pill cartridge 420, according to one embodiment. As shown in FIG. 7, the pill strip 610 is arranged in a zig-zag manner. When the gear 624 along with the winding cylinder 618 rotates clockwise while the gear 630 along with the winding cylinder 632 rotates counterclockwise as shown in FIG. 7, portions of the films in the pill strip 610 approaching the opening 510 are separated while the pill between the portions of the films is released from the pill strip 610 through the opening 510 into a compartment in the tray 220. By controlling the rotation of the winding cylinders 618, 632, a predetermined number of pills may be released from the pill strip 610 and dropped into the compartment of the tray 220.

Figure 8:
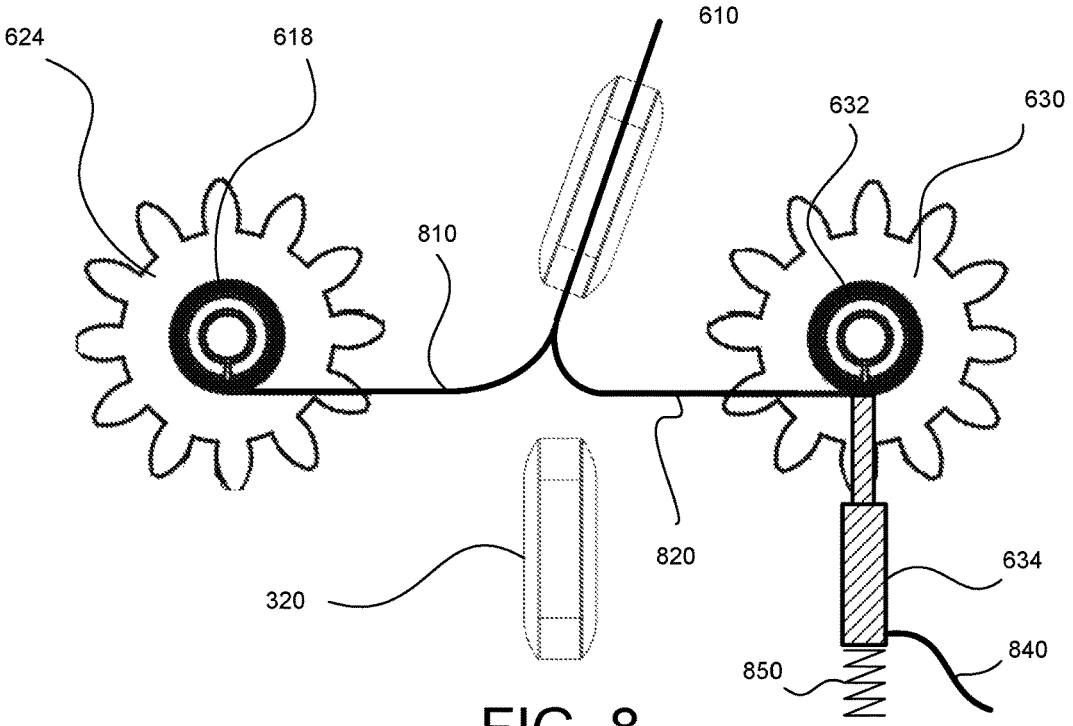
FIG. 8 is a schematic diagram illustrating a mechanism in the pill cartridge for moving pills and peeling films enclosing the pills, according to one embodiment.

FIG. 8 is a schematic diagram illustrating a mechanism in the pill cartridge 420 for separating films of the pill strip 610 containing the pills, according to one embodiment. The pill strip 610 includes a first film 810, a second film 820 and pills between the two films 810, 820. The first film 810 is wound on the winding cylinder 618 whereas the second film 820 is wound on the winding cylinder 632 as the gears 624, 630 are rotated. Due to the distance between the winding cylinders 618, 632, the first film 810 and the second film 820 are separated as they are wound onto the winding cylinders 618, 632.

One way of controlling the release of the pills is to rely solely on the number of rotations of the motor or by detecting current in the motor that varies depending on resistance encountered by the motor as the motor separates the films 810, 820. However, depending on factors such as the tension in the second film 820, thickness of second film 820 and slack in the second film 820 wound around the second winding cylinder 632, the length of second film 820 wound around the second winding cylinder 632 may vary. Hence, in order to more accurately control the length of the second film 820 wound on the second winding cylinder 632 and more tightly control the release of pills onto the tray, indicia provided in the pill strip 610 may be used.

In one embodiment, the sensing pins 634 contact an inner surface of the second film 820 to detect the indicia provided on the inner surface of the second film 820. For this purpose, the sensing pins 634 may be made of conductive material such as metal. When the indicia provided at certain locations of the second film 820 are detected, the resistance between the sensing pins 634 changes. The sensing pins 634 are connected to the indicia sensor via wires 840. By detecting the change of resistance across wires 840, the length of the second film 820 wound on the winding cylinder 632 can be determined. Therefore, by detecting the indicia, the separation of the films 810, 820 and the release of pills into the tray 220 can be more tightly controlled.

To ensure that the sensing pins 634 come into contact with the inner surface of the second film 820, a biasing spring 850 may be provided at an end of each pin 634. The biasing spring 850 pushes the sensing pins 634 towards the winding cylinder 632 so that the sensing pins 634 retain contact with the inner surface of the second film 820 when the second film 820 is wound around the winding cylinder 632.

In other embodiments, infra-red sensors or other optical sensors may be used in place of the sensing pins 634 to detect the indicia on the second film 820.

Figure 9:
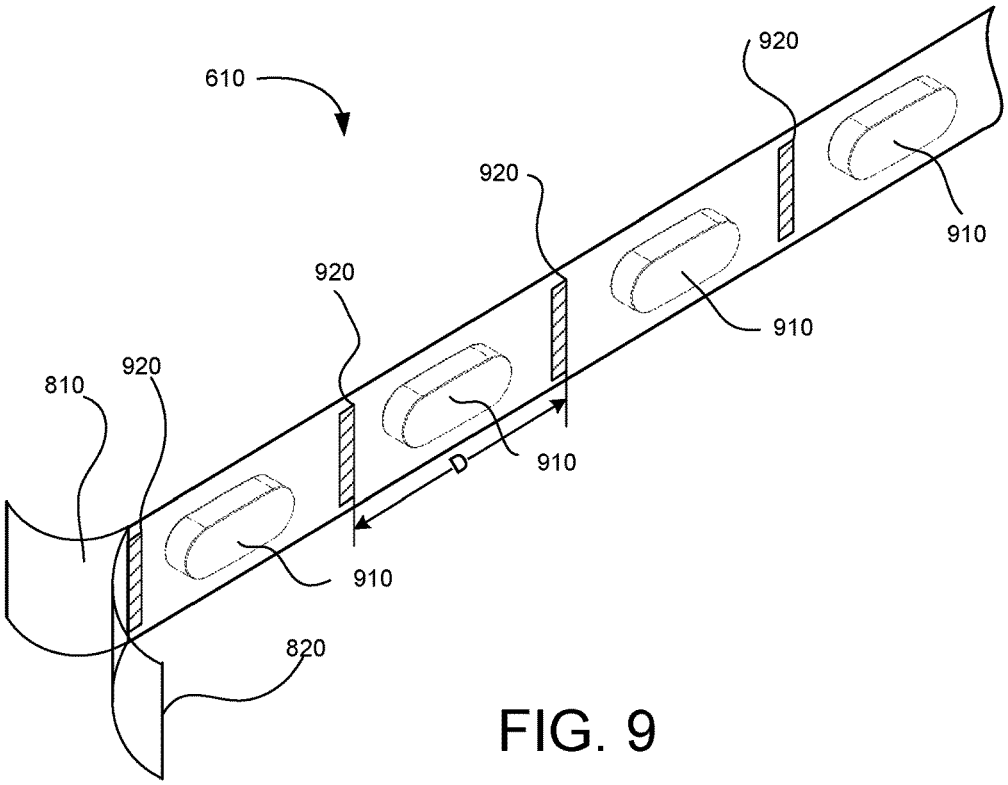
FIG. 9 is a perspective view of a pill strip enclosing pills between films, according to one embodiment.

FIG. 9 is a perspective view of the pill strip 610, according to one embodiment. The pill strip 610 includes the first film 810, the second film 820 and pills between these films. The first film 810 and the second film 820 are joined with the pills 910 placed between the two films. The films 810, 820 may be joined, for example, by using adhesive or by partially melting the films 810, 820.

In the inner surface of the second film 820, indicia 920 are printed with a certain interval D. The indicia 920 may be formed using conductive ink. The conductive ink may include, for example, silver, carbon or conductive nano particles. In the embodiment of FIG. 9, the indicia 920 are printed at both ends of the pills, which are also placed with the interval D. By detecting the locations of the indicia 920 at the indicia sensor as the second film 820 is wound around the winding cylinder 632, the control module 110 may determine how much of the pill strip 610 has progressed towards the opening 510.

In one embodiment, some or each of the indicia may have different resistance values. Hence, by detecting the resistance across the sensing pins 634, more accurate detection can be made as to how much of the pill strip 610 has been wound and how many pills have been released so far.

Although FIG. 9 illustrate the indicia 920 as being placed between the pills and only single pill as being placed between a pair of indicia, different configurations may enclose multiple pills between two adjacent indicia and place the indicia at locations where the pills are placed. Moreover, the distance between the indicia may vary along the length of the pill strip 610.

Although several embodiments are disclosed herein, various modifications can be made within the scope of the present disclosure. Accordingly, the disclosure of the present disclosure is intended to be illustrative, but not limiting, of the scope of the disclosure, which is set forth in the following claims.

The invention claimed is:

1. A pill cartridge, comprising:

a pill strip including a first film, a second film and pills enclosed between the first film and the second film, the pill strip comprising indicia provided at a predetermined interval along a length of the pill strip;

a first winding cylinder configured to separate the first film from the second film and wind the first film as the first winding cylinder is rotated;

a second winding cylinder configured to separate the second film from the first film and wind the second film separated from the first film; and a body configured to enclose the pill strip, the first winding cylinder and the second winding cylinder, the body formed with an opening through which a pill released from the pill strip exits the pill cartridge, the body further formed with one or more holes configured to receive one or more sensing pins for contacting the indicia, wherein the one or more sensing pins are pressed against the second winding cylinder to contact the indicia.

2. The pill cartridge of claim 1, wherein the pill cartridge further comprises at least one gear to rotate the first winding cylinder and the second winding cylinder.

3. The pill cartridge of claim 2, wherein the first winding cylinder is connected to a first gear and the second winding cylinder is connected to a second gear, the first and second gear coupled via a third gear and a fourth gear.

4. The pill cartridge of claim 2, further comprising a cover secured to the body, the cover formed with a hole to access the least one gear.

5. The pill cartridge of claim 1, wherein the indicia are provided in a surface of the second film facing the first film.

6. The pill cartridge of claim 1, wherein at least two of the indicia has a different resistance value.

* * * * *